US007499056B2

(12) United States Patent
Fukuda et al.

(10) Patent No.: US 7,499,056 B2
(45) Date of Patent: Mar. 3, 2009

(54) DISPLAY DEVICE AND DISPLAY CONTROL CIRCUIT

(75) Inventors: Takayuki Fukuda, Kumamoto (JP); Hirofumi Iwanaga, Kumamoto (JP); Jiro Takaki, Kumamoto (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 784 days.

(21) Appl. No.: 10/859,963

(22) Filed: Jun. 4, 2004

(65) Prior Publication Data

US 2004/0252112 A1 Dec. 16, 2004

(30) Foreign Application Priority Data

Jun. 16, 2003 (JP) ..... 2003-170237

(51) Int. Cl.
*G09G 5/36* (2006.01)

(52) U.S. Cl. ..... 345/560

(58) Field of Classification Search ..... 345/530–574
See application file for complete search history.

(56) References Cited

U.S. PATENT DOCUMENTS 5,708,455 A 1/1998 Maekawa
6,876,365 B1 * 4/2005 Tsutsui et al. ..... 345/536
2005/0225545 A1 10/2005 Takatori et al.

FOREIGN PATENT DOCUMENTS

| | | |
|---|---|---|
| EP | 0 678 845 A1 | 10/1995 |
| JP | H08-190372 | 7/1996 |
| JP | 10-49136 | 2/1998 |
| JP | 2001-174843 | 6/2001 |
| KR | 10-0371254 | 5/2003 |
| TW | 428158 | 4/2001 |

* cited by examiner

*Primary Examiner*—Sumati Lefkowitz
*Assistant Examiner*—Ke Xiao
(74) *Attorney, Agent, or Firm*—Oblon, Spivak, McClelland, Maier & Neustadt, P.C.

(57) ABSTRACT

In forward scanning, a timing control unit outputs the display data in the same sequence as the input display data. In backward scanning, on the other hand, the timing control unit inverts the output sequence of the display data for one line (for one horizontal cycle). Upon input of a scan direction control signal indicating backward scanning, the timing control unit executes sequence change processing by using line memory. The display data in which the sequence of the pixel data is reversed is outputted together with the control signals. It is able to select whether to output data in an inverted sequence or in a normal sequence according to the scan direction control signal.

14 Claims, 5 Drawing Sheets

DISPLAY DEVICE AND DISPLAY CONTROL CIRCUIT

BACKGROUND OF THE INVENTION

1. Field of the Invention

The present invention relates to a display device, and more particularly to a display device where display drive circuits for outputting display signals are disposed on a substrate of a display panel, and a display control circuit.

2. Description of the Related Art

As image display devices for personal computers and various other monitors, the use of liquid crystal devices is spreading remarkably. A liquid crystal display device typically has a liquid crystal display panel and a back light unit disposed on the rear face of the panel. The liquid crystal display panel displays images by controlling the transmission of light. One type of known liquid crystal device is the COG (Chip On Glass) type liquid crystal display device. In a COG type liquid crystal display device, a plurality of source driver ICs and/or a plurality of gate driver ICs are mounted on the glass substrate of the liquid crystal display panel. This can greatly contribute to reducing manufacturing cost.

Typically in a conventional liquid crystal display device, a timing controller and each source driver IC are connected by a separate line via the FPC (Flexible Printed Circuit). From the timing controller to each source driver IC, display signals and control signals are transmitted via each line. However, forming a line for each source driver IC makes the overall line length long and causes a cross-talk problem between lines. Thus, a method of cascade-connecting a plurality of source driver ICs with display signal transmission lines has been proposed.

The source driver ICs mounted on the glass substrate are cascade-connected for the transmission of display signals and control signals. Display signals and control signals outputted from the timing controller are inputted to the source driver IC in the first stage, which is disposed at the very edge of the substrate. When the latch processing of the display signals by the source driver IC in the first stage is over, the display signals are transmitted to the source driver IC in the next stage via the line on the substrate. The source driver IC in the second stage executes latch processing of the display signals according to the control signals, just as the source driver IC in the first stage. Hereafter, the source driver ICs in the subsequent stages repeat similar processing.

In the liquid crystal display device having cascade-connected COG type source driver ICs, a technique of decreasing the number of inputs of drivers and implementing COG & WOA (Line On Array) for cost reduction has been proposed (e.g. see Japanese Unexamined Patent Application Publication No. 2001-174843). In the liquid crystal display device, the source driver ICs, to which video signals inputted via video I/F are distributed, are cascade-connected and lines to each source driver IC are minimized to implement COG & WOA. In other words, this liquid crystal display device has liquid crystal cells that forms an image display area on the substrate and a source driver for applying a voltage to the liquid crystal cells based on the video signals inputted via the video I/F, and the source driver has a plurality of source driver ICs mounted on the same substrate as the liquid crystal cells and are cascade-connected by signal lines.

A typical source driver IC has a scan direction switching function. This function is used for ensuring flexibility in mounting the source driver IC and a correct display in a rotatable liquid crystal display device, which is used for a digital video and so on. For example, when a bare chip source driver IC is mounted on a TCP (Tape Carrier Package) in a TAB (Tape Automated Bonding) system, the chip is mounted on the rear face side or front face side of the TCP. Use of the scan direction switching function allows ICs with the same structure to be used for both the TCP and the COG of the rear face or front face packaging mode. It also allows the ICs with the same structure to be mounting on the top edge or the bottom edge of the substrate when the packaging mode is the same.

When the source driver ICs are cascade-connected for transmitting display signals, a conventional source driver IC must have a bi-directional buffer to switch the scan direction. The line for transmitting display signals is connected from the timing controller to the source driver IC at one end and to the source driver IC at the other end. To scan in a forward direction, the display signal is inputted to the source driver IC at the left end and transmitted to the source driver IC in the subsequent stage via the cascade-connection lines, for example. To scan in the backward direction, the display signal is inputted to the source driver IC at the right end and is transmitted to the source driver IC in the subsequent stage, in a direction opposite from the forward scan direction, via the cascade-connection lines. The transmission direction of each source driver IC is controlled by control signals.

In this way, having the bi-directional buffer, the input capacity of the source driver increases. If the capacity increases, the signal waveform is rounded, and the frequency with which the source driver IC normally operates drops. Further, the timing controller must have a display signal output terminal for each of the forward and backward scanning, which increases the number of terminals.

SUMMARY OF THE INVENTION

With the foregoing in view, it is an object of the present invention to provide a display device where display signals are transmitted between display drive circuits, capable of effective backward scanning.

To these ends, according to one aspect of the present invention, there is provided a display device including a display panel having a plurality of pixels to display images according to image display signals; a display drive circuit group having a plurality of display drive circuits for outputting image display signals to the display panel based on inputted display data; and a control circuit for outputting display data to the display drive circuit group, wherein the display data inputted to the display drive circuit group is sequentially transmitted between the display drive circuits, and the control circuit outputs display data for a predetermined number of pixels to the display drive circuit group in an inverted sequence. This enables effective output of the image display signals in an inverted sequence.

The display device according to the above aspect of the present invention preferably further includes memory, wherein the control circuit reads display data from the memory in an inverted sequence of a writing sequence of the display data inputted from an outside to the memory so as to invert the sequence of the display data. This enables to achieve an effective circuit configuration for inverting the display data. In is further preferred that this memory has a memory area for at least one line and a write area for display data in a (N−1)th line in the memory and a write area for display data in a Nth line in the memory at least partly overlap, and writing of the display data in the Nth line to the memory and reading of the display data in the (N−1)th line from the memory are executed in parallel. This enables to perform the inversion process in a small memory area. Alternatively, it is also preferred that the memory has memory areas for at least two lines, display data in the Nth line is written to a first memory area, and display data in the (N+1)th line is written to a second memory area. This enables to achieve a stable circuit configuration for the inversion process.

In the display device according to the above aspect of the present invention, the control circuit preferably outputs display data after inverting or without inverting a sequence, depending on control signals inputted from an outside. This allows selection of the display data output sequence. Further, if outputting the display data without inverting, the control circuit preferably outputs the display data without writing to the memory. This contributes to the reduction of power consumption.

In the display device according to the above aspect of the present invention, the display data for a predetermined number of pixels is preferably display data for one line. This enables to perform the image display process of the display panel effectively.

According to another aspect of the present invention, there is provided a display control circuit for a display device including a plurality of display drive circuits which are cascade-connected for sequentially transmitting display data, including memory; a control circuit for reading display data from the memory in an inverted sequence of a writing sequence of the display data for one line inputted from an outside to the memory; and an output circuit for outputting the display data in the inverted sequence acquired from the control circuit to a display drive circuit group having the display drive circuits. This enables effective output of the image display signals in an inverted sequence.

According to yet another aspect of the present invention, there is provided a display device including a display panel having a plurality of pixels to display images according to image display signals; a display drive circuit group having a plurality of display drive circuits for outputting image display signals to the display panel based on display data that is inputted; and a control circuit for outputting display signals to the display drive circuit group, wherein the display data inputted to the display drive circuit group is sequentially transmitted between the display drive circuits, and the control circuit selects outputs in the same sequence as or in a reversed sequence of an input sequence of the display data inputted from an outside based on control signals. This allows selection of the display data output sequence.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE PREFERRED EMBODIMENTS

Preferred embodiments of the present invention will be described hereinbelow. The following description explains some embodiments of the present invention, and the present invention shall not be limited to the embodiments below. To clarify explanations, the following description may be omitted or simplified if necessary. An individual skilled in this art shall be able to easily change, add or transform each element of the following embodiments within the scope of the present invention. In each drawing, the same composing elements are denoted with the same reference symbols, for which description will be omitted.

Figure 1:
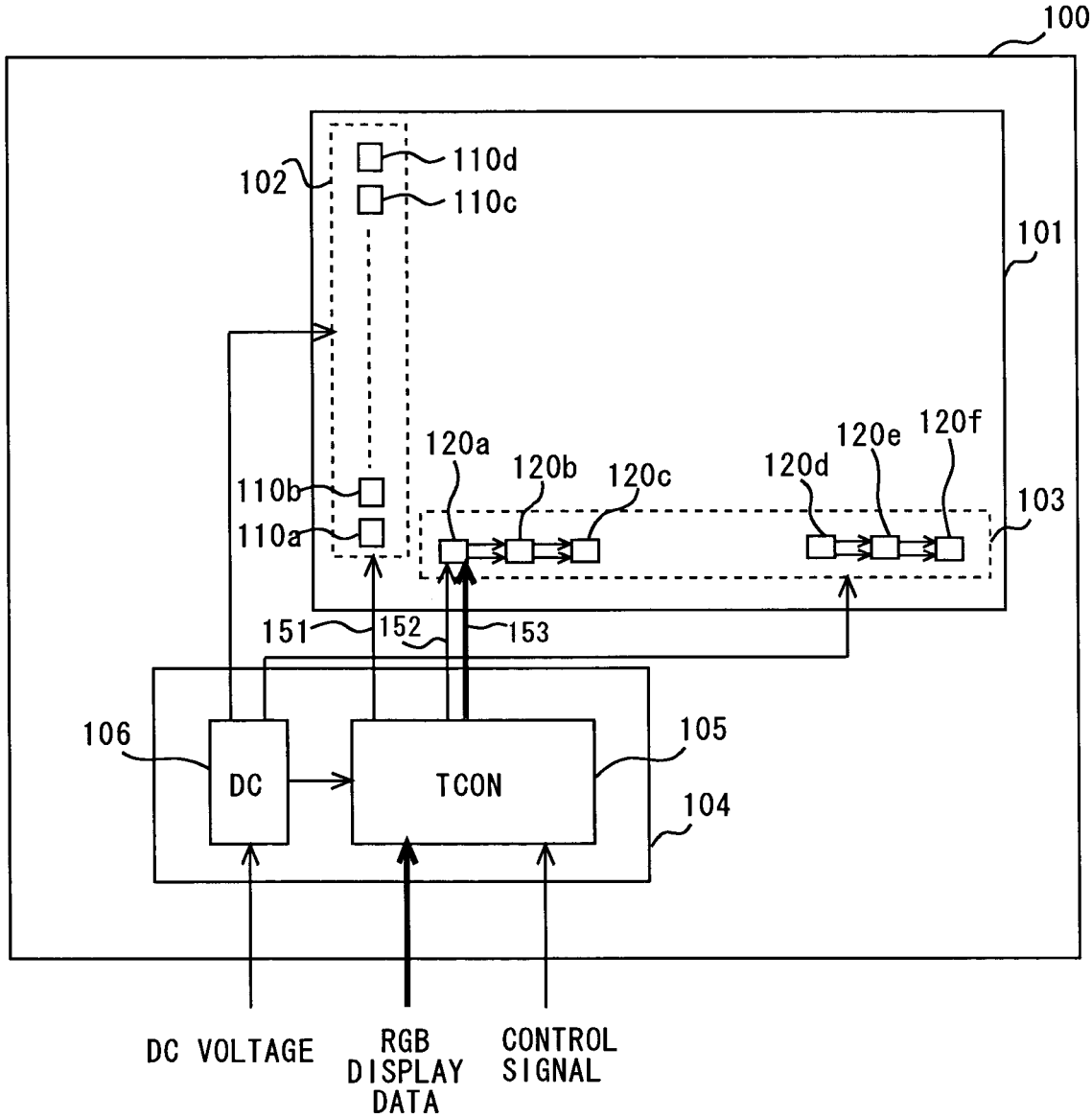
FIG. 1 is a block diagram depicting a general configuration of the liquid crystal display device according to a specific embodiment of the present invention.

FIG. 1 is a block diagram depicting a general configuration of the liquid crystal display device 100 according to one embodiment of the present embodiment. The liquid crystal display device 100 in FIG. 1 includes a liquid crystal display panel 101, a gate driver circuit unit 102, a source driver circuit unit 103, and a control circuit unit 104. The control circuit unit 104 has a timing controller 105 and a power supply circuit unit 106. The power supply circuit unit 106 has a DC/DC converter to generate a voltage to be supplied to each circuit from the DC voltage supplied by an external power supply. The voltage from the DC/DC converter is supplied to each circuit of the gate driver circuit unit 102, the source driver circuit unit 103, and the timing controller 105.

The liquid crystal display panel 101 has a display area consisting of a plurality of pixels arrayed in a matrix fashion and a screen frame area which is a peripheral area of the display area. The liquid crystal display panel 101 has an array substrate where an array circuit is formed and a counter substrate, and liquid crystals are sealed between these two substrates. In the active matrix type liquid crystal display panel, each pixel has a switching element to control the input/output of image display signals. A typical switching element is TFT (Thin Film Transistor).

A color liquid crystal display device has an RGB color filter layer on the counter substrate. Each pixel in the display area of the liquid crystal display panel 101 displays one of the R, G and B colors. Of course in a monochrome display, either black or white is displayed. In the display area on the array substrate, a plurality of signal lines and gate lines are disposed in a matrix fashion. The signal lines and the gate lines are disposed so as to overlap perpendicular to each other, and the TFT is disposed adjacent to the intersection. Each pixel selected by the gate voltage inputted from the gate driver circuit unit 102 applies an electric field on a liquid crystal based on the image display signal voltage inputted from the source driver circuit unit 103.

The gate driver circuit unit 102 has a plurality of gate driver ICs 110. In FIG. 1, the gate driver ICs 110*a* to 110*d* are shown. The source driver circuit unit 103 has a plurality of source driver ICs 120, which is an example of a display drive circuit. In FIG. 1, the source driver ICs 120*a* to 120*f* are shown. The driver ICs of this embodiment are directly mounted on or formed on an insulation substrate of the array substrate. Typically, as FIG. 1 shows, a plurality of source driver ICs 120 for signal lines are disposed at the X axis side of the TFT array substrate, and a plurality of gate driver ICs 110 for gate lines controlling gate voltages are disposed at the Y axis side of the TFT array substrate.

The voltage inputted from the source driver ICs 120 is sent to the pixel electrodes via the source/drain of the TFTs, and the pixel electrodes and the common electrodes apply an electric field to the liquid crystals. By changing this voltage, the applied voltage to the liquid crystals can be changed, and the light transmittance of the liquid crystals is controlled. The circuit which applies a common voltage to the common electrodes is formed on the control circuit substrate. Besides the abovementioned active matrix type, a simple matrix type, which has no switching element, is known as the liquid crystal display panel. The present invention may be applied to various types of liquid crystal display panels, and to various types of display devices where the display is controlled by the driver circuit unit, such as an organic or inorganic EL (Electro Luminescence) display device.

To the timing controller 105, RGB display data and control signals from an external personal computer are inputted via the video interface. The control signals include a dot clock signal, which is the input cycle of one pixel of the display data, a synchronization signal, such as a horizontal synchronization signal or a vertical synchronization signal, and a scan direction control signal. The timing controller 105 processes data received via the video interface, and outputs various signals or data to be supplied to each driver IC of the gate driver circuit unit 102 and the source driver circuit unit 103 at a necessary timing.

The timing controller 105 supplies the control signals 151 to the gate driver circuit unit 102, and supplies the control signals 152 and the display data 153 to the source driver circuit unit 103. Each driver IC of the gate driver circuit unit 102 and the source driver circuit unit 103 input or output gate signals or image display signals at a timing according to the control signals. In a typical liquid crystal display device, the gate driver circuit unit 102 outputs gate signals from the first line to the subsequent lines so as to sequentially scan pixels in each line.

To the gate driver circuit unit 102, start pulse signals, clock signals and enable signals are inputted by the timing controller 105. The gate driver ICs 110 are cascade-connected, and the start pulse signals are sequentially transmitted in the gate driver circuit unit according to the clock signals. By the start pulse signals selecting gate lines to which the ON signal is outputted, and by the enable signals controlling the output of the gate signals, the ON signals are sequentially outputted in each gate line.

The plurality of source driver ICs 120 are cascade-connected for transmitting the display data. In other words, the display data for each source driver IC 120 is transmitted between the source driver ICs 120. The display data is transmitted between adjacent source driver ICs 120 via the lines formed on the substrate. The control signals 152 and the display data 153 from the timing controller 105 are inputted to the source driver IC 120*a* disposed at the very edge of the source driver circuit unit 103. The inputted display data and the control signals are transmitted to the source driver IC 120 in the subsequent stage via the transmission line on the substrate between the source driver ICs and each source driver IC 120. The cascade-connected source driver ICs may be disposed on another substrate, rather than on the substrate of the panel 101.

Figure 2:
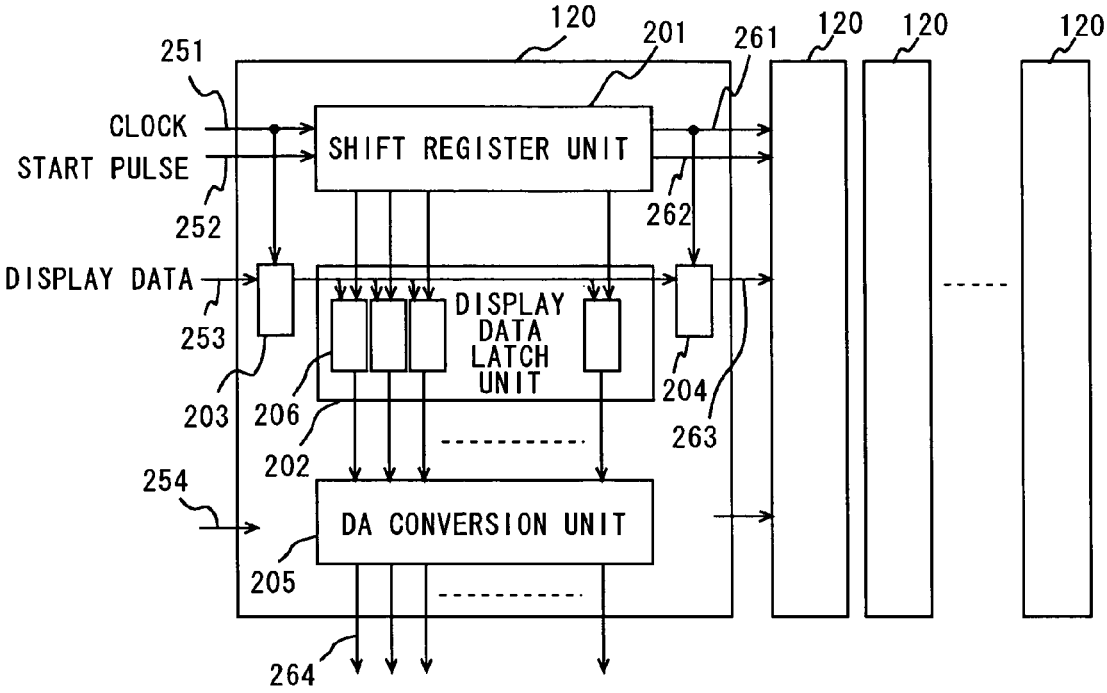
FIG. 2 is a circuit block diagram depicting a general configuration of the source driver IC according to a specific embodiment of the present invention.

FIG. 2 is a circuit block diagram depicting the configuration of the source driver IC 120 according to this embodiment. The source driver IC 12 in FIG. 2 includes a shift register unit 201, a display data latch unit 202, an input latch 203, an output latch 204, and a DA conversion circuit unit 205. The display data latch unit 202 has a plurality of latches 206, and each latch 206 latches the display data to be outputted to each signal line.

To the shift register unit 201, the clock signals 251 and the start pulse signals 252 are inputted from the outside. The display data 253 is inputted to the input latch 203. In addition to these, the display control signals 254 are inputted to the source driver IC. The display control signals control the DA conversion timing, the reference voltage signals, and so on. These signals are transmitted between the cascade-connected source driver ICs 120 via the lines on the substrate.

The start pulse signals 252 inputted to the shift register unit 201 are sequentially transmitted in the shift register unit 201 according to the clock signals 251. Sequential output from the shift register unit 201 is inputted to each latch 206 of the display data latch unit 202. The display data 253 is latched by the input latch 203 for timing adjustment, and then is inputted to the display data latch unit 202. In the display data latch unit 202, each latch 206 sequentially latches display data according to the sequence of output from the shift register unit 201.

When all the latches 206 latch the display data, the clock signals 261, the start pulse signals 262 and the display data 263 are transferred to the source driver IC in the subsequent stage. Typically the display data 263 consists of 6 to 8 bits of binary data for each of R, G and B. The output latch 204 adjusts the timing to secure a margin for the display data latching timing in the subsequent stage. When latch processing by all the source driver ICs ends, the image display signals 264, which are analog signals converted by the DA conversion unit 205 for displaying images on the liquid crystal display panel, are simultaneously outputted to each signal line. When the display for one horizontal period ends, the gate driver circuit unit 101 selects the pixel lines to be displayed, and the above processing is repeated.

Figure 3:
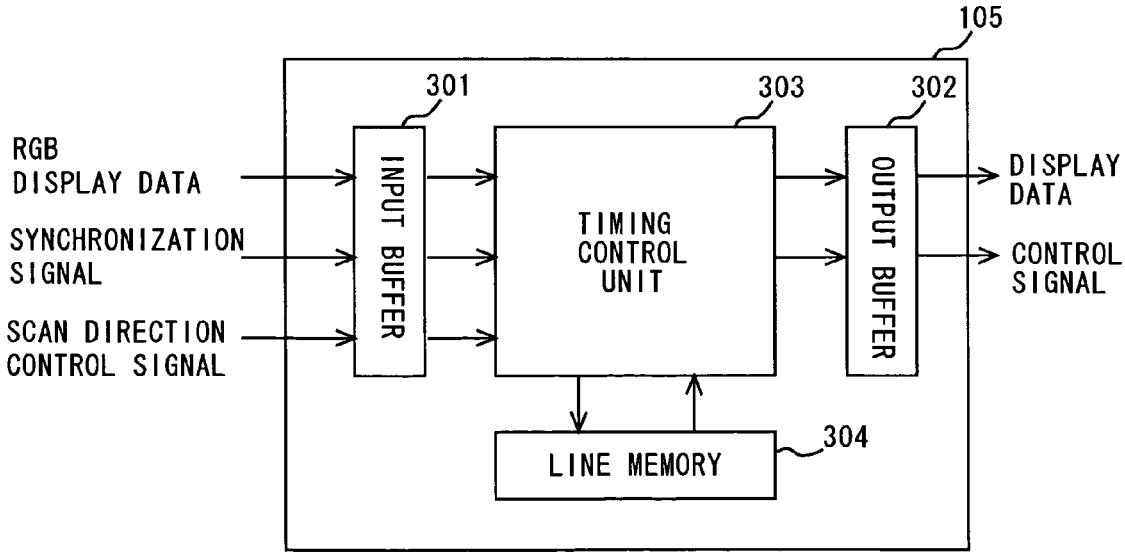
FIG. 3 is a circuit block diagram depicting the timing controller according to a specific embodiment of the present invention.

FIG. 3 is a block diagram depicting the general configuration of the timing controller 105 according to this embodiment. The timing controller 105 can switch the output sequence of the display data so as to enable backward scanning of the image display signals. The timing controller 105 in FIG. 3 includes an input buffer 301, an output buffer 302, a timing control unit 303, and a line memory 304. The display data and such control signals as synchronization signals and scan direction control signals from the outside are inputted to the input buffer 301.

The timing control unit 303 acquires these signals/data from the input buffer 301 and executes the necessary processing for generating the required output signals/data. The timing control unit 303 generates the control signals to be inputted to the gate driver circuit unit 102, and the control signals and the display data to be inputted to the source driver circuit unit 103 based on the input signals/data. The timing control unit 303 executes the processing for changing the output sequence of the inputted display data according to the scan direction control signals.

In the forward scanning, the timing control unit 303 outputs the display data in the same sequence as the input display data. In the backward scanning, on the other hand, the timing control unit 303 generates one line of (one horizontal cycle of) the display data in a different sequence from the sequence of the input display data. Specifically, the output sequence of the pixel data in one line is an inverted sequence of the input sequence of the pixel data in one line. Upon input of the scan direction control signals indicating backward scanning, the timing control unit 303 executes the sequence change processing using the line memory 304.

Acquiring the display data from the input buffer 301, the control unit 303 writes the display data into the line memory 304. The line memory 304 can store one or a plurality of lines of the display data. When all the data for one line is stored, for example, the display data is sequentially acquired from the line memory 304 from the data corresponding to the last pixel written in the line memory 304 last. In this way, the line memory 304 can function as a stack type memory (or LIFO memory). The display data, which is the reversed sequence of the pixel data, is outputted along with the control signals from the output buffer 302.

The sequence conversion processing using the line memory 304 can be executed at an appropriate step in the data conversion processing in the timing control unit. To select the sequence of the output data, the timing control unit 303 inputs the inputted display data to the line memory 304, and selects whether to acquire the data from the line memory 304 and output it in an inverted sequence, or to output the data acquired from the input buffer 301 in a normal sequence, depending on the scan direction control signals.

Alternatively, if the scanning direction control signal indicates the output in the normal sequence, the timing control unit 303 may directly output the display data acquired from the input buffer 301 without inverting the sequence, not writing the display data into the line memory 304. By omitting write processing to the memory, power can be saved and EMI can be decreased. It is also possible to configure the timing controller 105 in such a way that, when outputting the display data for forward scanning, it stores the display data once in the line memory 304 and then reads it out from the memory in the same sequence as the input sequence so as to output the display data in the normal sequence.

Figure 4:
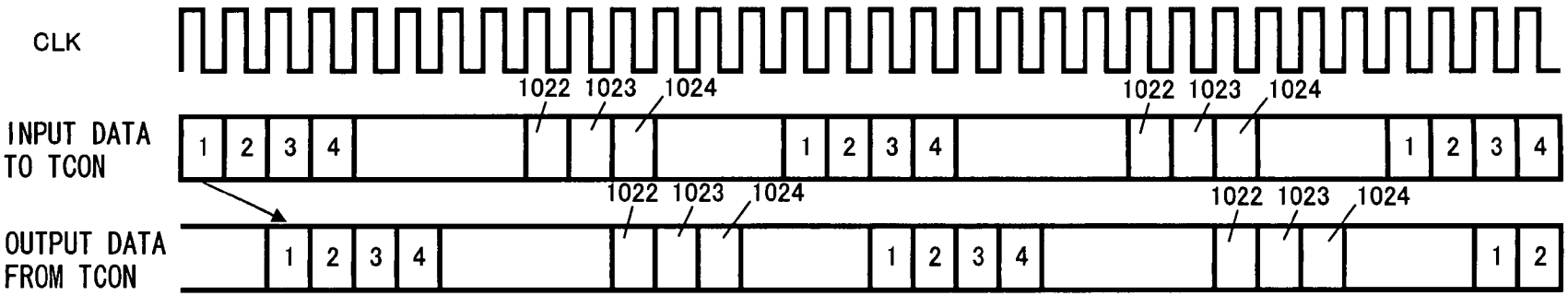
FIG. 4 is a timing chart depicting the operation timing of the timing controller according to a specific embodiment of the present invention.

FIG. 4 is a timing chart depicting an example of the operation timing in the timing controller 105. In this example, one line of pixel data is 1024. FIG. 4 shows an example of the input timing of the display data to the timing controller 105 and the output timing of the display data from the timing controller 105 in forward scanning. When the display data is inputted to the timing controller 105 in the predetermined sequence according to the clock signals, the display data is outputted from the timing controller 105 in the same sequence after a predetermined number of clocks have elapsed. In other words, when first to 1024th pixel data are inputted, the first to 1024th pixel data are sequentially outputted in the same sequence. The number of shift clocks between the input and output differs depending on the design.

Figure 5:
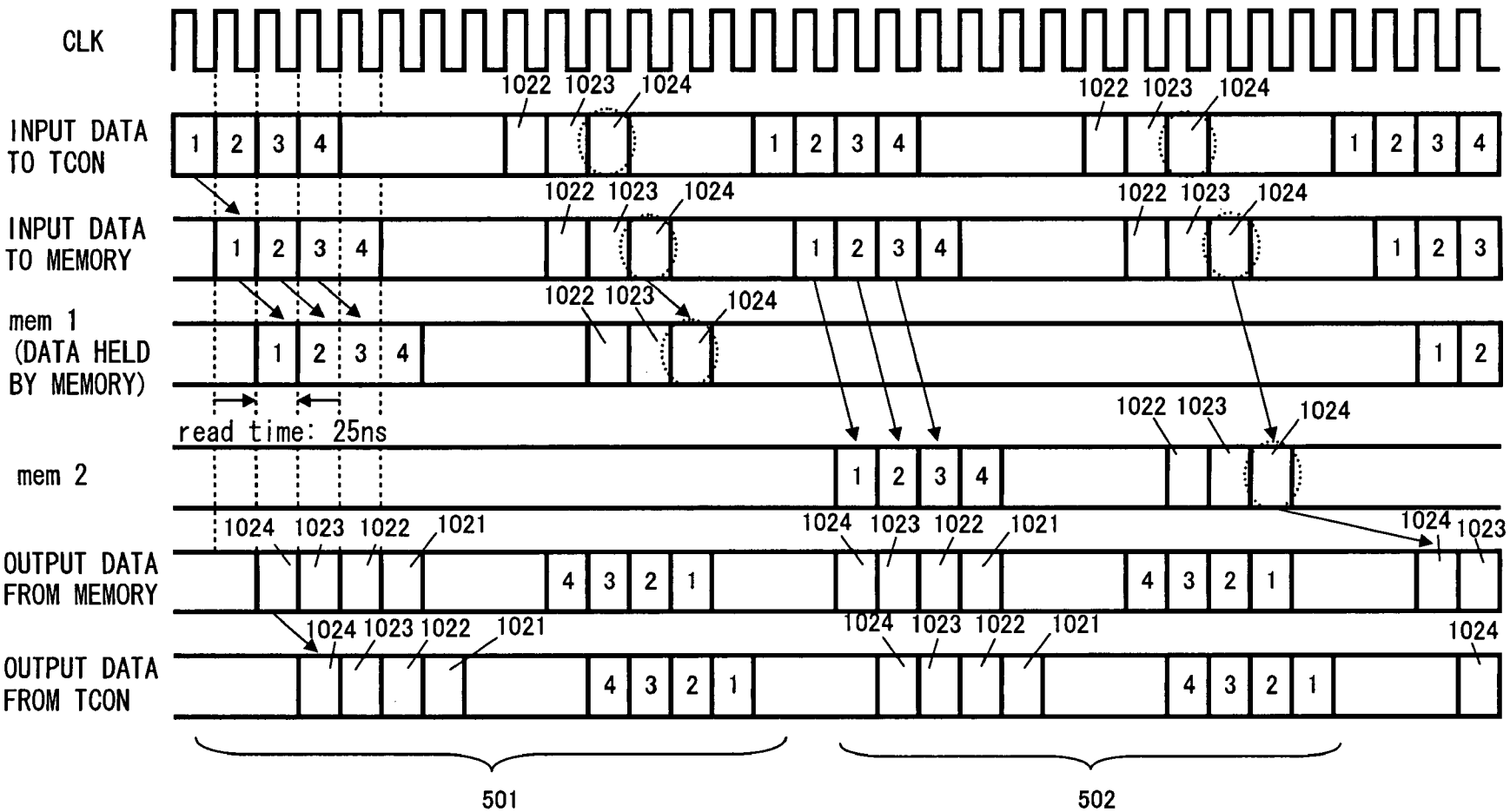
FIG. 5 is a timing chart depicting the operation timing of the timing controller according to a specific embodiment of the present invention.

FIG. 5 shows a timing example in the case where the line memory for two lines is used in backward scanning mode. In the example of the following processing, all processing is executed in synchronization with the rise edge of the clock signals. The line memory 304 has first and second line memory. FIG. 5 shows the timings of the input data to the timing controller 105, the data input to the input/output unit of the first or second line memory, the data stored in the first line memory, the data stored in the second line memory, the data output from the first or second line memory to the input/output unit of the memory, and the data outputted from the timing controller 105.

Processing in the time block indicated as 501 will now be described. One pixel data (e.g. indicated as "1"), which is inputted to the timing controller 105 in a predetermined sequence according to the clock signals (e.g. 1 clock=25 ns), is stored in the input/output unit of the first line memory in the next clock timing, for example. In the next clock timing, one pixel of data ("1") is stored in the memory. The above processing is repeated for the one line of display data in the same sequence as the input sequence to the timing controller 105. The first line memory sequentially stores all of the one line of data in the Nth line (N is a natural number).

In parallel with the data input/write processing in the Nth line, write/output processing of the display data in the (N−1) th line from the second line memory is executed. The output sequence of the data from the line memory is an inverted sequence of the input sequence of the data to the line memory, and in this example, the 1024th pixel data is first outputted. The data outputted from the second line memory is outputted from the output buffer 302 after a predetermined number of clocks (e.g. one clock) has elapsed.

When the output processing from the second line memory ends and the one line of data is stored in the first line memory, the display data in the Nth line is read out from the first line memory and outputted through the input/output unit of the line memory in an inverted sequence of the sequence of the data when stored in the first line memory in the time block indicated as 502. The outputted display data is then outputted from the timing controller 105 in the next clock timing, for example, in the inverted sequence of the input sequence. In parallel with the data output from the first line memory or the timing controller 105, the display data input processing of the (N+1)th line to the timing controller 105 or the second line memory is executed.

When the data in the (N+1)th line is inputted to the timing controller 105 in the time block 502, the data is stored in the second line memory in the same sequence as the input sequence. This processing is executed in parallel with the abovementioned processing of reading the Nth line data from the first line memory. When the display data for one line is stored, the display data is outputted from the second line memory in an inverted sequence of the input sequence. Hereafter the same processing is repeated in the lines in the subsequent stages. If line memory for two lines is used, writing or reading to or from the line memory can be executed at timings in synchronization with the rise or fall edge of the clocks, as is the case with other processing. It is also possible to use memory for three or more lines.

Figure 6:
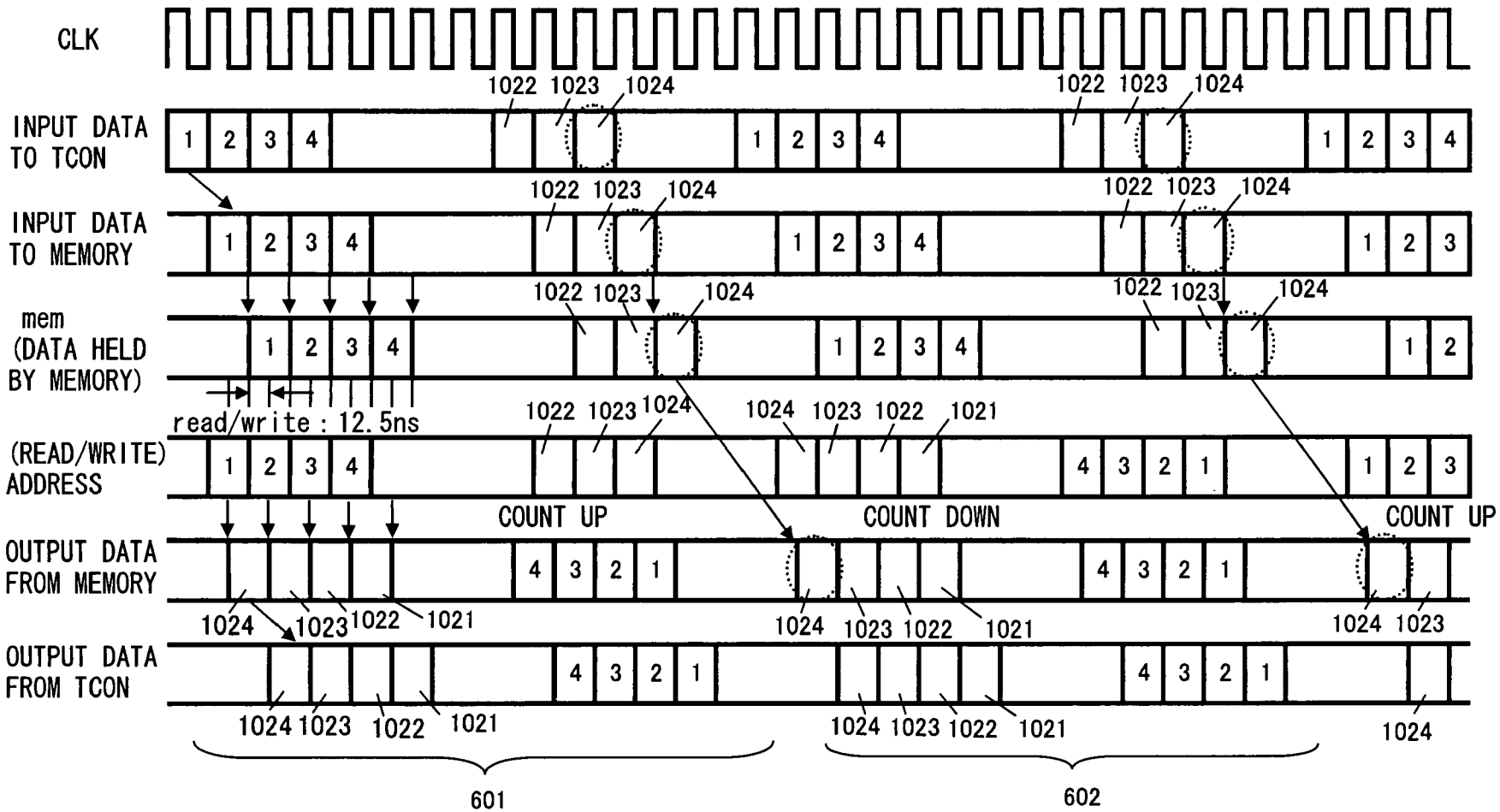
FIG. 6 is a timing chart depicting the operation timing of the timing controller according to a specific embodiment of the present invention.

FIG. 6 shows the timings in the case of using line memory for one line in backward scanning mode. FIG. 6 shows the timings of the input data to the timing controller 105, the input data to the input/output unit of the line memory, the data stored in the memory, the read/write address, the data outputted from the line memory to the input/output unit of the memory, and the data outputted from the timing controller 105.

In the time block indicated as 601, when one pixel data (e.g. pixel data indicated as "1") is inputted to the timing controller 105 according to the rise edge of the clock signals (e.g. one clock=25ns), the data is written to the input/output unit of the line memory at the next rise edge timing, for example. The write sequence of each pixel data is the same as the input sequence of the data to the timing controller 105. At the next rise edge timing, the write processing of the pixel data "1" to the line memory is executed, and the data is stored in the memory. At this time, the address data indicates the address value "1" (this is different from the reference symbol of the display data).

Since the present embodiment has a memory area for one line only, the pixel data of the previous line is outputted from the same address before input processing to the line memory. Thus, in parallel with the data input/write processing for the Nth line, data read/output processing for the (N−1)th line is executed. Read processing from the line memory is executed at a timing a half clock before the write processing. When the write processing is executed at the timing of the rise edge, data is read from the same address at a timing of the previous fall edge.

Referring to the block 601 in FIG. 6, the pixel data "1024" in the (N−1)th line stored in the address "1" is outputted a half clock before the pixel data "1" in the Nth line is stored in the memory. Hereafter, the address value is counted up, and each pixel data in the Nth line is written to the line memory in the same sequence as the input sequence of the display data to the timing controller 105. In parallel with this processing, each pixel data at the (N−1)th line is read from the line memory.

The read sequence is an inverted sequence of the write sequence. In this way, according to this embodiment, memory write/read processing is executed at a frequency twice the other operation frequency. If one line of data has M number of pixel data (M is a natural number), the (M+1−k)th data in the Nth line is stored in the area where the kth data (k is a natural number) in the (N−1)th line (N is a natural number) is stored. In this configuration, the display data in each line is sequentially stored in the memory area for one line.

When the read/output processing of the display data in the (N−1)th line and the input/write processing of the display data in the Nth line end, processing for the display data in the next line is executed in the time block indicated as 602. To the timing controller 105, the display data in the (N+1)th line is inputted and the display data in the Nth line is outputted. The address value is counted down, which is opposite from the write/read processing of the previous line. In this way, by switching the address count direction for each processing line, the write sequence and the read sequence to and from the memory of the one line of display data can be inverted. Hereafter, by repeating the above processing, the display data in the inverted sequence is inputted to the source driver circuit unit 103. Though the display device has an area for one line only in this embodiment, it may have memory area for between one and two lines.

According to the present embodiment, in a display device having cascade-connected source driver ICs for transmitting display data, forward scanning or backward scanning can be executed without increasing the number of terminals or lines of the timing controller.

According to the present invention, in the display device where the display data is transmitted between drive circuit units, the display data transmission direction can be effectively switched.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A display device, comprising:

a display panel comprising a plurality of pixels configured to display images according to image display signals;

a display drive circuit group comprising a plurality of display drive circuits configured to output the image display signals to the display panel based on display data inputted from a control circuit;

the control circuit configured to output the display data to the display drive circuit group; and a line memory configured to only store the display data to be outputted by the control circuit in an inverted sequence, wherein the display drive circuit group is configured to sequentially transmit the display data between the plurality of display drive circuits, the control circuit is configured to store the display data in the line memory before outputting the display data for a predetermined number of pixels to the display drive circuit group in the inverted sequence, and the control circuit is configured to receive and directly output the display data, when outputting the display data for the predetermined number of pixels to the display drive circuit group in a normal sequence.

2. The display device according to claim 1, wherein the control circuit is configured to read the display data from the line memory in the inverted sequence of a writing sequence of the display data inputted from outside the line memory so as to invert the sequence of the display data.

3. The display device according to claim 1, wherein the control circuit is configured to output the display data after inverting or without inverting a sequence, depending on control signals inputted from an outside.

4. The display device according to claim 2, wherein the line memory comprises a memory area for at least one line of the display data, and a write area for the display data in a (N−1)th line in the line memory and a write area for the display data in a Nth line in the line memory at least partly overlap in the memory area, and writing of the display data in the Nth line to the line memory and reading of the display data in the (N−1)th line from the line memory are executed in parallel.

5. The display device according to claim 2, wherein the line memory comprises memory areas for at least two lines, the display data in the Nth line is written to a first memory area, and the display data in the (N+1)th line is written to a second memory area.

6. The display device according to claim 1, wherein the display data for the predetermined number of pixels is display data for one line.

7. A display control circuit for a display device comprising a plurality of display drive circuits which are cascade-connected and configured to sequentially transmit display data, the display control circuit comprising:

a line memory configured to only store the display data to be outputted by a control circuit in an inverted sequence;

the control circuit configured to read the display data from the line memory in the inverted sequence of a writing sequence of the display data for one line inputted from outside the line memory; and an output circuit configured to output the display data in the inverted sequence acquired from the control circuit to a display drive circuit group including the display drive circuits, wherein the control circuit is configured to store the display data in the line memory, before outputting the display data to the display drive circuit group in the inverted sequence, and the control circuit is configured to receive and directly output the display data to the display drive circuit group, when outputting the display data in a normal sequence.

8. A display device, comprising:

a display panel comprising a plurality of pixels configured to display images according to image display signals;

a display drive circuit group comprising a plurality of display drive circuits configured to output the image display signals to the display panel based on the display data that is inputted from a control circuit;

the control circuit configured to output the display data to the display drive circuit group; and a line memory configured to only store the display data to be outputted by the control circuit in a reversed sequence, wherein the display drive circuit group is configured to sequentially transmit the display data between the plurality of display drive circuits, the control circuit is configured to select outputs in the same sequence as, or in the reversed sequence of, an input sequence of the display data inputted from an outside based on control signals, and the control circuit is configured to receive and directly output the display data to the display drive circuit group, when outputting the display data in the same sequence as the input sequence.

9. The display device according to claim 1, wherein the line memory is external to the control circuit, and the control circuit is configured to receive and directly output the display data without storing the display data in any memory external to the control circuit, when outputting the display data for the predetermined number of pixels to the display drive circuit group in the normal sequence.

10. The display device according to claim 1, wherein the line memory is external to the control circuit, and the control circuit is configured to output the display data and a control signal to the display drive circuit group.

11. The display control circuit according to claim 7, wherein the line memory is external to the control circuit, and the control circuit is configured to receive and directly output the display data to the display drive circuit group without storing the display data in any memory external to the control circuit, when outputting the display data in the normal sequence.

12. The display control circuit according to claim 7, wherein the line memory is external to the control circuit, and the control circuit is configured to output the display data and a control signal to the display drive circuit group.

13. The display device according to claim 8, wherein the line memory is external to the control circuit, and the control circuit is configured to receive and directly output the display data to the display drive circuit group without storing the display data in any memory external to the control circuit, when outputting the display data in the normal sequence.

14. The display device according to claim 8, wherein the line memory is external to the control circuit, and the control circuit is configured to output the display data and a control signal to the display drive circuit group.

* * * * *